US005812689A

United States Patent [19]

Liao

[11] Patent Number: 5,812,689

[45] Date of Patent: Sep. 22, 1998

[54] LOW-POWERED LOUD SPEAKER PROVIDED WITH ECHO GENERATOR

[76] Inventor: Yu-Tse Liao, No. 35, Chung Jeng Road, Ta-Ya Hsien, Taichung Hsien, Taiwan

[21] Appl. No.: 917,762

[22] Filed: Aug. 27, 1997

[51] Int. Cl.[6] ..... H04R 25/00

[52] U.S. Cl. ..... 381/159; 381/64; 381/65

[58] Field of Search ..... 381/90, 152, 159, 381/61, 63, 64, 65

[56] References Cited

U.S. PATENT DOCUMENTS 2,837,597 6/1958 Lubow ..... 381/64

4,007,332 2/1977 Berg ..... 381/65

*Primary Examiner*—Huyen Le

*Attorney, Agent, or Firm*—Browdy and Neimark

[57] ABSTRACT

A low-powered loud speaker is provided with one or more echo generators composed of an insulation tube, a first magnetic permeability element, a second magnetic permeability element, and an induction coil wound around the insulation tube. The first and the second magnetic permeability elements are engaged with the insulation tube such that the first magnetic permeability element is suspended, and that the second magnetic permeability element is induced to generate a magnetic attraction at such time when a sound frequency current passes the echo generator. The echo generator is thus capable of vibration twice the sound frequency, so as to simulate the echo effects.

12 Claims, 2 Drawing Sheets

LOW-POWERED LOUD SPEAKER PROVIDED WITH ECHO GENERATOR

FIELD OF THE INVENTION

The present invention relates generally to a loud speaker, and more particularly to a loud speaker provided with an echo generator capable of the repetition of a sound to simulate the echo, so as to enhance the listening effect.

BACKGROUND OF THE INVENTION

The high-powered loud speaker, such as the stereophonic loud speaker, is capable of bringing about the stereophonic effect by generating the sound waves which are reflected by the wall, the floor and the ceiling of a room in which the loud speaker is at work. On the other hand, the low-powered loud speaker, such as the headphone or the telephone receiver, has a low output power incapable of generating the stereophonic effect.

SUMMARY OF THE INVENTION

The primary objective of the present invention is therefore to provide a low-powered loud speaker with an echo generator capable of simulating the stereophonic effect.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
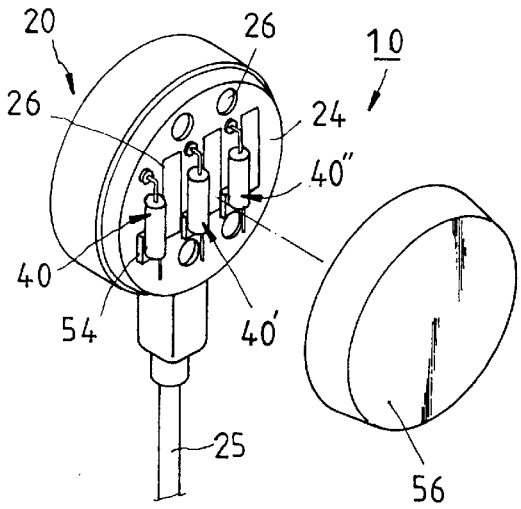
FIG. 1 shows a perspective view of the embodiment of the present invention.
Figure 2:
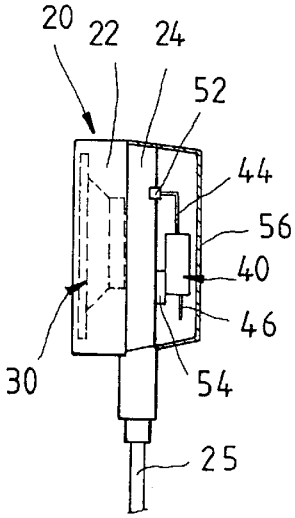
FIG. 2 is a side view of the present invention as shown in FIG. 1.

As illustrated in FIGS. 1 and 2, a low-powered loud speaker device 10 of the embodiment of the present invention is used in an earphone and composed of the component parts described hereinafter.

A housing 20 has a receiving space 22 for disposing a low-powered loud speaker 30 of an output power less than one watt. The loud speaker 30 is actuated by the current transmitted by a wire 25 which is connected with the housing 20. The loud speaker 30 is capable of converting electrical signals to sound waves, which are radiated into the air.

The loud speaker 30 embodied in the present invention is provided with three echo generators 40, 40' and 40", each of which is an electromagnetic vibrator.

Figure 3:
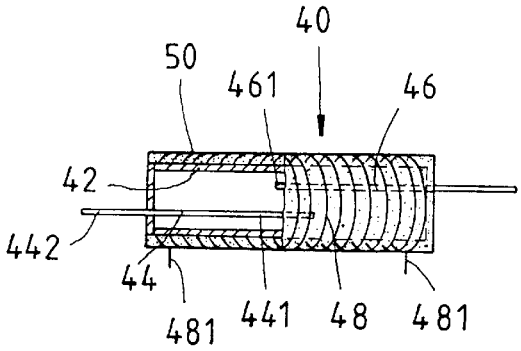
FIG. 3 shows a sectional schematic view of an echo generator of the present invention.

As shown in FIG. 3, each of three echo generators is composed of the following components.

An insulation tube 42 is made of a glass material.

A first magnetic permeability element 44 of a minute iron alloy piece or column has one end, which is inserted into the insulation tube 42 such that another end of the first element 44 is located outside the insulation tube 42. A second magnetic permeability element 46 of a minute iron alloy piece is similarly engaged with the insulation tube 42. The inner ends 441 and 461 of the first element 44 and the second element 46 are stacked. A coil 48 is wound around the insulation tube 42 such that the coil 48 is covered by a protective layer 50 of a resin material, and that both ends 481 of the coil 48 are not covered by the protective layer 50.

The echo generator 40 is located in a back housing 24 of the housing 20 such that the outer end 442 of the first element 44 is fastened with the back housing 24 by a fastening element 52, and that the first element 44 is suspended to facilitate the vibrating action. The back housing 24 is provided with a soundproof pad 54 for separating the echo generator from the back housing 24. The back housing 24 is covered by an outer cover 56 for enclosing the echo generator.

Figure 4:
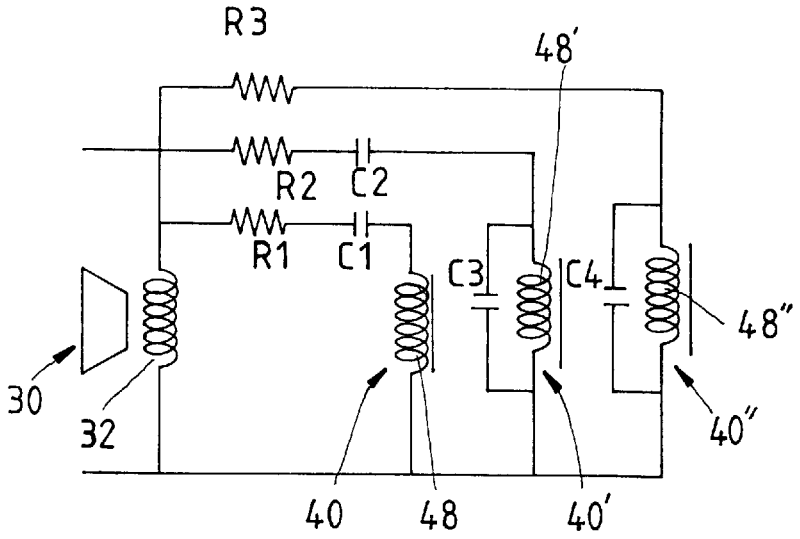
FIG. 4 shows a circuit diagram of the preferred embodiment of the present invention.

As shown in FIG. 1, the back housing 24 of the low-powered loud speaker 30 of the present invention is provided with three echo generators 40. The coils 48 of the echo generators 40 and the coils 32 of the loud speaker 30 are arranged in parallel connection to form three current shunts, as shown in FIG. 4. These three echo generators 40, 40' and 40" have a current input end, which is connected with a resistance, $R_1$, $R_2$, or $R_3$. These resistances $R_1$, $R_2$, and $R_3$ have a large resistance coefficient allowing the passage of the relatively small current. The current frequency of the three shunts is controlled by $R_1$ and $R_2$, which are connected respectively with the capacitor C, and the capacitor $C_2$. A high frequency current is attained via $R_1$ and $C_1$. As a result, the echo generator 40 is capable of controlling the high-pitch area. An intermediate frequency current is attained via $R_2$ and $C_2$, so as to enable the echo generator 40' to serve to control the intermediate pitch area. A low frequency current is attained by $R_3$ such that the echo generator 40" controls the low-pitch area. The coil 48' and 48" of the echo generators 40' and 40" are arranged with the capacitors $C_3$ and $C_4$ in parallel connection, so as to form an LC circuit having a delay action.

Figure 5:
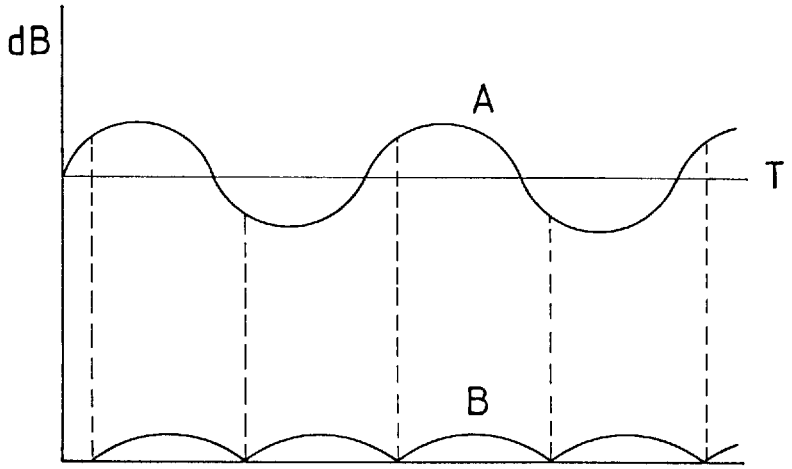
FIG. 5 is a diagram showing the relationship between the sound frequency of a low-powered loud speaker and the sound frequency of an echo generator.

In operation, the current flows through the circuit shown in FIG. 4. The wave form of the main current flowing through the loud speaker 30 is the sine wave, as indicated by A in FIG. 5. The small currents flow through the shunts to reach the inductive coil 48 of the echo generator 40. The magnetic field formed by the inductive coil 48 is responsible for causing the magnetic permeability elements 44 and 46 to have magnetism. As a result, the elements 44 and 46 are capable of generating the alternating N-S pole magnetic attraction every half period. In other words, one attraction is brought about respectively by positive half period and negative half period. The attraction frequency is twice of the voice frequency of the main current. As the second magnetic permeability element 46 is attracted, it is caused to vibrate to cause the echo generator to bring about the vibration frequency twice the voice frequency, as shown by B in FIG. 5. The vibration frequency is transmitted to the housing 20 via the outer end 441 of the first magnetic permeability element 44. The housing 20 serves as a voice-transmitting medium capable of radiating the sound waves into air. However, the radiation of the sound waves is delayed in view of the delay effect of the echo generator 40.

In order to avert the resonance of the frequency of the echo generator 40 and the frequency of the loud speaker 30, the housing 20 must be made of a material capable of preventing resonance, or the back housing 24 is provided with a plurality of air holes 26 for reducing the cavity resonance.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A low-powered loud speaker device comprising:

a housing provided therein with a receiving space, said housing further provided with a back housing;

a low-powered loud speaker disposed in said receiving space of said housing; and at least one echo generator disposed in the back housing, said at least one echo generator consisting of an insulation tube, a first magnetic permeability element engaged with said insulation tube, a second magnetic permeability element engaged with said insulation tube such that said second magnetic permeability element can be caused to swing by magnetic attraction, and a coil wound around said insulation tube such that said coil is capable of inducing said second magnetic permeability element to generate a magnetic attraction.

2. The device as defined in claim 1, wherein said first magnetic permeability element is fastened at one end thereof with said back housing of said housing, so as to keep said echo generator suspended from said back housing.

3. The device as defined in claim 1, wherein said first and second magnetic permeability elements are inserted respectively into two ends of said insulation tube.

4. The device as defined in claim 1, wherein said coil and said insulation tube are shielded by a protective layer.

5. The device as defined in claim 1, wherein said back housing is shielded with a cover such that said echo generator is enclosed by said cover.

6. The device as defined in claim 1, wherein said back housing and said echo generator are provided therebetween with a soundproof pad.

7. The device as defined in claim 1, wherein said back housing is provided with a plurality of perforations.

8. The device as defined in claim 2, wherein said one end of said first magnetic permeability element is provided with a means for fastening said one end with said back housing of said housing.

9. The device as defined in claim 3, wherein one end of said first magnetic permeability element is parallel to one end of said second magnetic permeability element.

10. The device as defined in claim 1, wherein said first magnetic permeability element is a metal piece.

11. The device as defined in claim 1, wherein said second magnetic permeability element is a metal piece.

12. The device as defined in claim 1, wherein said first magnetic permeability element is a metal column.

* * * * *